US008523323B2

(12) United States Patent
Essen et al.

(10) Patent No.: US 8,523,323 B2
(45) Date of Patent: Sep. 3, 2013

(54) METHOD AND APPARATUS FOR MOUNTING A FLUID EJECTION MODULE

(75) Inventors: Kevin Von Essen, San Jose, CA (US); Stephen R. Deming, San Jose, CA (US); John A. Higginson, Santa Clara, CA (US); Nobuo Matsumoto, Kanagawa (JP); Andreas Bibl, Los Altos, CA (US)

(73) Assignee: FUJIFILM Corporation, Tokyo (JP)

( * ) Notice: Subject to any disclaimer, the term of this patent is extended or adjusted under 35 U.S.C. 154(b) by 64 days.

(21) Appl. No.: 12/991,758

(22) PCT Filed: May 6, 2009

(86) PCT No.: PCT/US2009/042994

§ 371 (c)(1),
(2), (4) Date: Feb. 8, 2011

(87) PCT Pub. No.: WO2009/142910

PCT Pub. Date: Nov. 26, 2009

(65) Prior Publication Data

US 2011/0128324 A1 Jun. 2, 2011

Related U.S. Application Data

(60) Provisional application No. 61/055,911, filed on May 23, 2008.

(51) Int. Cl.
*B41J 2/14* (2006.01)
*B41J 2/16* (2006.01)

(52) U.S. Cl.
USPC ..... 347/49; 347/40

(58) Field of Classification Search
USPC ..... 347/20, 40–43, 49, 85–86, 102, 108
See application file for complete search history.

(56) References Cited

U.S. PATENT DOCUMENTS 4,825,227 A 4/1989 Fischbeck et al.
4,940,998 A 7/1990 Asakawa (Continued)

FOREIGN PATENT DOCUMENTS

CN 1149535 A 5/1997
CN 1579770 A 2/2005

(Continued)

OTHER PUBLICATIONS

International Search Report and Written Opinion dated Jul. 2, 2009 issued in international application No. PCT/US2009/042994, 8 pgs.

(Continued)

*Primary Examiner* — Thinh Nguyen
(74) *Attorney, Agent, or Firm* — Fish & Richardson P.C.

(57) ABSTRACT

A system and method for mounting a fluid droplet ejection module to a frame is disclosed, where the fluid ejection module includes a mounting component having a mounting surface. A connector is configured to detachably attach to the frame and is positioned between the frame and the mounting surface of the fluid ejection module. A portion of a mating surface of the connector is positioned adjacent the mounting surface of a corresponding fluid ejection module and is in direct contact with the mounting surface. One or more recesses are formed in at least one of either the mounting surface of the fluid ejection module or the mating surface of the connector. The one or more recesses have a substantially uniform thickness and are filled with an adhesive. The adhesive is cured after aligning the fluid ejection module to the frame.

15 Claims, 12 Drawing Sheets

(56) References Cited

U.S. PATENT DOCUMENTS

| | | | |
|---|---|---|---|
| 5,826,333 | A | 10/1998 | Iketani et al. |
| 5,874,971 | A | 2/1999 | Nishioka et al. |
| 5,997,125 | A | 12/1999 | Nishioka et al. |
| 6,000,784 | A | 12/1999 | Takemoto et al. |
| 6,068,367 | A | 5/2000 | Fabbri |
| 6,074,036 | A | 6/2000 | Nishioka et al. |
| 6,305,784 | B1 | 10/2001 | Hino |
| 6,499,828 | B1 | 12/2002 | Iketani et al. |
| 6,554,398 | B2 | 4/2003 | Wyngaert et al. |
| 7,360,875 | B2 | 4/2008 | Terakura et al. |
| 2005/0156986 | A1 | 7/2005 | Silverbrook et al. |

FOREIGN PATENT DOCUMENTS

| | | |
|---|---|---|
| EP | 1258354 | 11/2002 |
| JP | 09-183229 | 7/1997 |
| JP | 10-024589 | 1/1998 |
| JP | 11-010850 | 1/1999 |
| JP | 2004-160875 | 6/2004 |
| JP | 2006-264181 | 10/2006 |
| JP | 2007-237440 | 9/2007 |
| JP | 2007-281286 | 10/2007 |
| JP | 2008-179081 | 8/2008 |
| WO | 2006/116393 | 11/2006 |
| WO | 2009/142910 | 11/2009 |

OTHER PUBLICATIONS

International Preliminary Report on Patentability dated Dec. 2, 2010 issued in Internationanl Application No. PCT/US2009/042994, 7 pgs.

Office action issued Nov. 26, 2012 in corresponding Chinese application No. 200980118608.1, 8 pgs.

Japanese Office Action in Japanese Application No. 2011-510557, mailed Jun. 24, 2013, 6 pages (with English translation).

METHOD AND APPARATUS FOR MOUNTING A FLUID EJECTION MODULE

CROSS-REFERENCE TO RELATED APPLICATIONS

This application is the national stage of International Application Number PCT/US2009/042994, entitled "Method and Apparatus for Mounting a Fluid Ejection Module ", filed on May 6, 2009,which is based on and claims the benefit of the filing date of U.S. Provisional Application No. 61/055,911, entitled "Method and Apparatus for Mounting a Fluid Ejection Module", filed on May 23, 2008, both of which as filed are incorporated herein by reference in their entireties.

BACKGROUND

The following description relates to mounting a fluid ejection module to a print frame. An ink jet printer, typically includes an ink path from an ink supply to an ink nozzle assembly that includes nozzles from which ink drops are ejected. Ink drop ejection can be controlled by pressurizing ink in the ink path with an actuator, for example, a piezoelectric deflector, a thermal bubble jet generator, or an electrostatically deflected element. A typical printhead module has a line or an array of nozzles with a corresponding array of ink paths and associated actuators, and drop ejection from each nozzle can be independently controlled. In a so-called "drop-on-demand" printhead module, each actuator is fired to selectively eject a drop at a specific location on a medium. The printhead module and the medium can be moving relative one another during a printing operation.

In one example, a printhead module can include a semiconductor printhead body and a piezoelectric actuator. The printhead body can be made of silicon etched to define pumping chambers. Nozzles can be defined by a separate substrate that is attached to the printhead body. The piezoelectric actuator can have a layer of piezoelectric material that changes geometry, or flexes, in response to an applied voltage. Flexing of the piezoelectric layer pressurizes ink in a pumping chamber located along the ink path.

Printing accuracy can be influenced by a number of factors. Precisely positioning the nozzles relative to the medium can be necessary for precision printing. If multiple printheads are used to print contemporaneously, then precise alignment of the nozzles included in the printheads relative to one another also can be critical for precision printing. Maintaining alignment of the printheads during and after alignment and mounting can be important.

SUMMARY

This invention relates to mounting a fluid ejection module to a frame. In one aspect, the systems and methods disclosed herein feature a frame configured to mount a fluid ejection module that includes a mounting component having a mounting surface. One or more connectors are configured to detachably attach to the print frame and are positioned between the frame and the mounting surface of the fluid ejection module. A portion of a mating surface of the connector positioned adjacent to the mounting surface of the corresponding fluid ejection module is in direct contact with the mounting surface. One or more recesses are formed in at least one of either the mounting surface of the fluid ejection module or the mating surface of the connector, wherein the one or more recesses have a substantially uniform thickness and are filled with an adhesive. The adhesive is a substantially uniform layer formed within the one or more recesses and is cured after aligning the fluid ejection module to the frame.

In another aspect, the systems and methods disclosed herein feature attaching a first surface of a connector to the frame and positioning a mounting surface of the fluid ejection module adjacent to an opposing second surface of the connector. At least one of either the mounting surface or the opposing second surface of the connector includes one or more recesses filled with an adhesive. The fluid ejection module is aligned to the frame, and after aligning the fluid ejection module, the adhesive positioned between the mounting surface and the second surface of the connector is cured thereby securing the fluid ejection module to the connector. A portion of the mounting surface of the fluid ejection module and a portion of the second surface of the connector are in direct contact and the adhesive is positioned such that substantially all contraction of the adhesive during curing occurs perpendicular to the mounting surface.

In another aspect, the systems and methods disclosed herein feature a frame configured to mount one or more MEMS device assemblies. Each of the one or more MEMS device assemblies includes a mounting component having a mounting surface. One or more connectors are configured to detachably attach to the frame and are positioned between the frame and the mounting surfaces of the one or more MEMS device assemblies. A portion of a mating surface of the connector is positioned adjacent to the mounting surface of a corresponding MEMS device assembly and is in direct contact with the mounting surface. One or more recesses are formed in at least one of either the mounting surfaces of the one or more MEMS device assemblies or the mating surfaces of the one or more connectors. The one or more recesses have a substantially uniform thickness and are filled with an adhesive. The adhesive comprises a substantially uniform layer formed within the one or more recesses, wherein the adhesive corresponding to a MEMS device assembly is cured after aligning the MEMS device assembly to the frame.

In another aspect, the systems and methods disclosed herein feature a frame configured to mount one or more fluid ejection modules and one or more fluid ejection modules. Each fluid ejection module includes a mounting component having a first mounting surface and a second mounting surface. One or more connectors are configured to detachably attach to the frame. For each fluid ejection module, a first connector is positioned between the frame and the first mounting surface and a second connector is positioned between the frame and the second mounting surface. One or more recesses are formed in at least one or either the first and second mount surfaces of the one or more fluid ejection modules or a mating surface of the one or more connectors. The one or more recesses have a substantially uniform thickness and are filled with an adhesive. The adhesive includes a substantially uniform layer formed within the one or more recesses. For each fluid ejection module, the adhesive at an interface between the first mounting surface and the first connector is cured after aligning the fluid ejection module to the frame in a first direction, and the adhesive at an interface between the second mounting surface and the second connector is cured after aligning the fluid ejection module to the frame in a second direction and a third direction.

Implementations of the invention can include one or more of the following features. A screw can detachably attach the connector to the frame. At least a portion of the connector can comprise a light-transmissive material and the adhesive can be cured by exposure to light transmitted through the light-transmissive portion of the connector. The one or more fluid ejection modules can include fiducials for aligning the one or more fluid ejection modules to the frame. The adhesive can be positioned such that substantially all contraction of the adhesive during curing occurs perpendicular to the mounting surface. The mounting component can include one or more openings configured to receive a second adhesive at an interface between the mounting component and the connector. Each of one or more MEMS device assemblies can include an actuator, a sensor, or both. A system may also include a bracket having a first mating surface and a second mating surface, the first mating surface being attached by a first connector to the frame and the second mating surface being attached by a second connector to the mounting component.

One or more of the following additional features may also be included. Aligning the fluid ejection module to the frame can include aligning the fluid ejection module to one or more fluid ejection modules mounted to the frame. Curing the adhesive can include exposing the adhesive to ultra-violet light through the light-transmitting portion of the connector. Aligning the fluid ejection module can include aligning a mask to the frame, aligning a first pair of cameras to fiducials on the mask, and aligning the fluid ejection module with a second pair of cameras that are in a fixed relationship with the first pair of cameras. Aligning the fluid ejection module can include calibrating the first pair of cameras and the second pair of cameras using a calibrating mask.

Implementations of the invention can realize one or more of the following advantages. The connector can be detachable, so a fluid ejection module can be removed from the print frame after the adhesive is cured. Removal can be done without breaking an adhesive bond between the connector and the print frame, and potential damage to other fluid ejection modules and the print frame is mitigated or prevented. The adhesive may be positioned between the connector and the mounting component, and most contraction or shrinkage (if any) of the adhesive may occur in a direction perpendicular to the nozzle face. Because contraction in this direction will not have as significant an effect on fluid ejection module alignment as contraction in other directions, improved alignment may be obtained. The use of a transparent connector permits use of adhesives that are cured by ultraviolet light. Such adhesives can provide none, some, or all of the following advantages. Thermal expansion of parts can cause misalignment of the fluid ejection module, but ultraviolet light imparts little or no heat to the components being bonded, so little or no thermal expansion may occur during curing. Such adhesives may also have longer working times than other adhesives, which permits more time for proper alignment of the fluid ejection module. Such adhesives may also cure more rapidly than other types of adhesives, thus facilitating faster mounting of the fluid ejection module. In implementations using a secondary adhesive, the adhesive cured by ultraviolet light can maintain accurate alignment of the fluid ejection module while the secondary adhesive provides improved bond strength.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A method, apparatus, and system are described for mounting a fluid ejection module to a frame (referred to herein as a "frame" or "print frame"). Precise alignment of a fluid ejection module is desirable for accurate fluid ejection, e.g., printing. When combining two or more fluid ejection modules for printing, each fluid ejection module should be precisely aligned relative to the other fluid ejection modules for printing accuracy. The method, apparatus, and system described herein advantageously provide for precise alignment of a fluid ejection module when mounting the fluid ejection module to a print frame, while also providing for easy removal of a single fluid ejection module, for example, to repair or replace the fluid ejection module.

A first surface of a connector is connected to a print frame. The connector can be formed at least in part from a material that allows the transmission of light, e.g., at least a portion of the connector can be transparent or translucent. In one example, the connector is formed from glass. The print frame is configured to mount one or more fluid ejection modules. A mounting surface of the fluid ejection module is positioned adjacent to an opposing second surface of the connector. The fluid ejection module is then aligned to the print frame and/or to one or more fluid ejection modules mounted to the print frame. After aligning the fluid ejection module, an adhesive 485 (see FIG. 4B) positioned between the mounting surface and the second surface of the connector can be cured, thereby securing the fluid ejection module to the connector. The fluid ejection module is thereby coupled to the print frame. Preferably, the connector is detachably connected to the print frame, and therefore, if the fluid ejection module must be removed, the connector can be detached from the print frame.

Figure 1A:
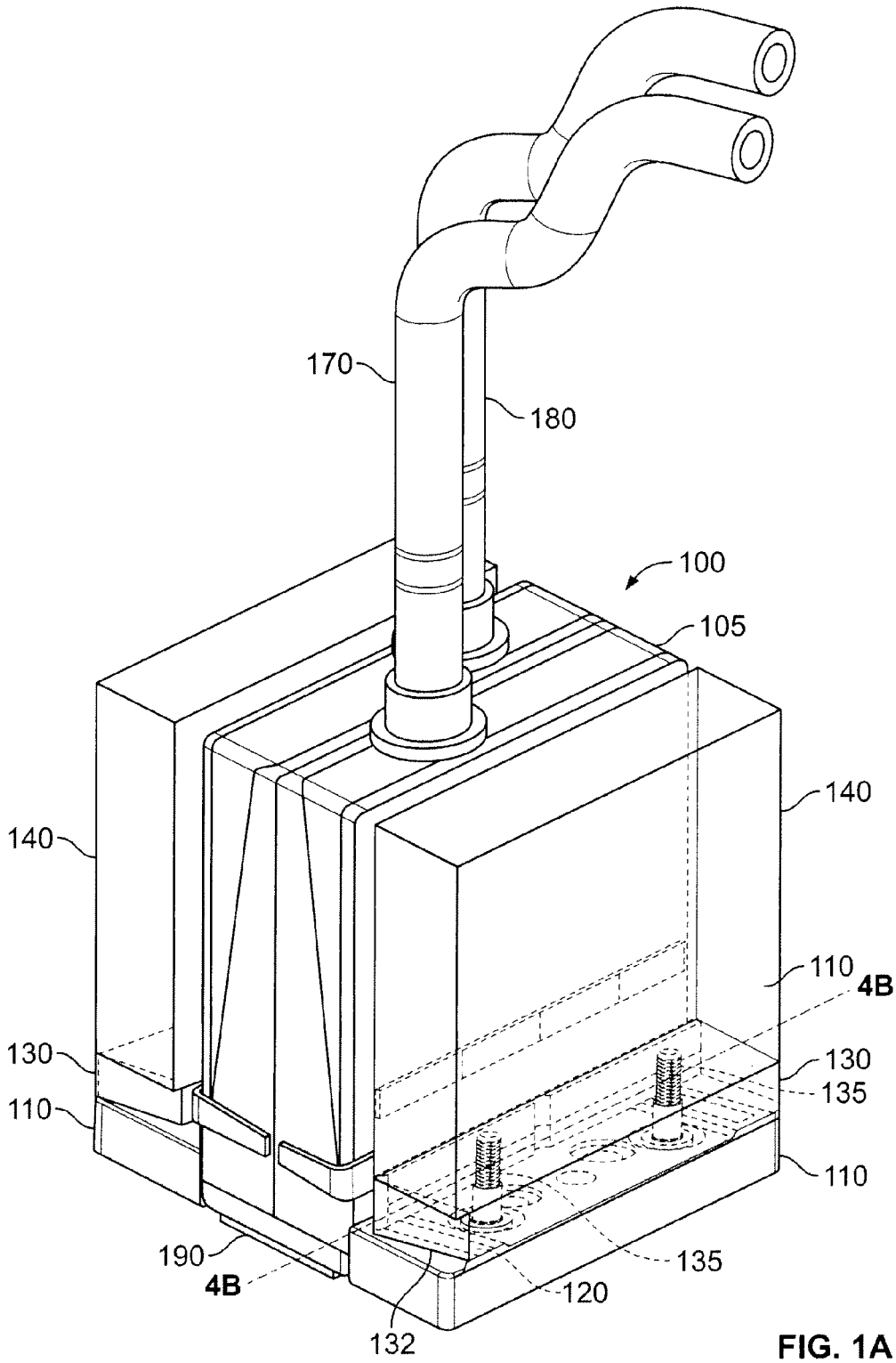
FIG. 1A is a perspective view of an example fluid ejection module mounted to a print frame.

FIG. 1A shows an example fluid ejection module 100 mounted to a print frame 140. Some hidden features are illustrated with broken lines in FIG. 1A. In some implementations, the fluid ejection module 100 can be included in a fluid ejection system including multiple fluid ejectors, e.g., printheads. Each fluid ejector can include a fluid ejection module, such as fluid ejection module 100. The fluid ejection module 100 can include a rectangular plate-shaped printhead module, which can be a substrate fabricated using semiconductor processing techniques. Each fluid ejection module 100 can also include a housing to support the printhead module, along with other components such as a flex circuit to receive data from an external processor and to provide drive signals to the printhead module. The printhead module can include a substrate in which a plurality of fluid flow paths are formed. The printhead module also includes a plurality of actuators to cause fluid to be selectively ejected from the flow paths. Thus, each flow path with its associated actuator provides an individually controllable micro-electromechanical system (MEMS) fluid ejector. The substrate can include a flow-path body, a nozzle layer, and a membrane layer. The flow-path body, nozzle layer, and membrane layer can each be silicon, e.g., single crystal silicon. The fluid flow path can include a fluid inlet, an ascender, a pumping chamber adjacent the membrane layer, and a descender that terminates in a nozzle formed through the nozzle layer. Activation of the actuator causes the membrane to deflect into the pumping chamber, forcing fluid out of the nozzle.

Referring again to FIG. 1A, the example fluid ejection module 100 shown includes a printhead casing 105. The fluid ejection module 100 also includes a mounting component 110 having a mounting surface 120. A connector 130 is positioned on the mounting surface 120, between the fluid ejection module 100 and the print frame 140. The connector 130 can be transparent or, alternatively, translucent. The connector 130 is attached to the print frame 140 using screws 135, which are shown in broken lines in FIG. 1A. Alternatively, a single screw 135 can be used, or other fastening techniques can be used, e.g., pins or rivets. As discussed above, preferably the connector 130 is detachably affixed to the print frame 140, so as to allow relatively easy removal at a later time without causing damage to the print frame 140. The connector 130 can have a mating surface 132 opposite the print frame 140. The mounting component 110 of the fluid ejection module 100 is bonded to the connector 130 (e.g., to the mating surface 132 of the connector 130), for example, by the adhesive 485. The mounting component 110 can include apertures (see FIG. 4B) configured to allow removal of the screws 135, thereby allowing removal of the fluid ejection module 100 from the print frame 140.

The fluid ejection module 100 includes a fluid inlet 170, a fluid outlet 180, and a substrate 190 configured for ejection of droplets of a fluid. The fluid can be, for example, a chemical compound, a biological substance, or ink. In other implementations, the fluid ejection module 100 does not include a fluid outlet 180 (which optionally can provide for a recirculation scheme for the printing fluid).

Figure 1B:
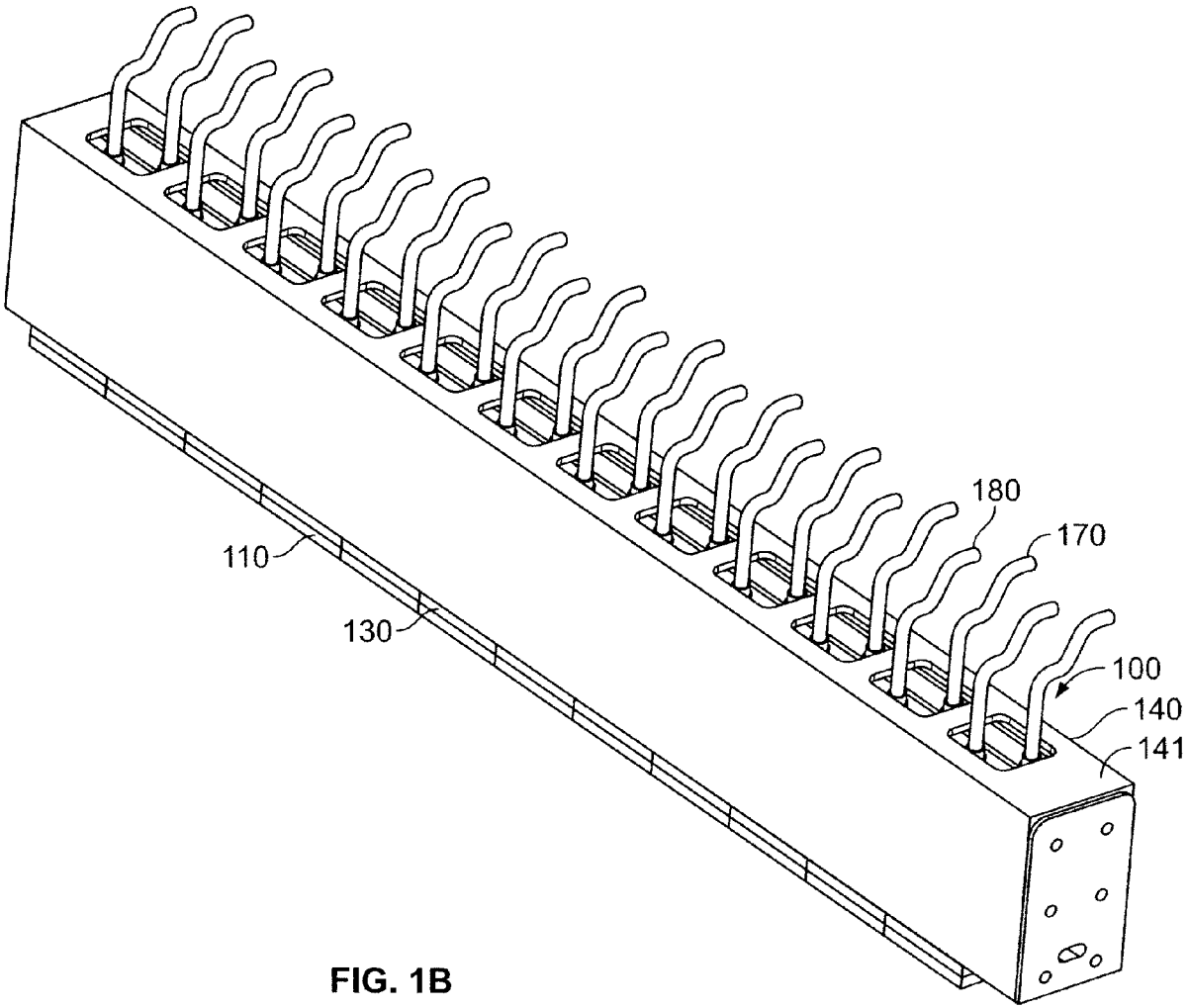
FIG. 1B is a perspective view of multiple fluid ejection modules mounted to a print frame.

FIG. 1B shows multiple fluid ejection modules 100 mounted to the print frame 140. Each fluid ejection module 100 includes a mounting component 110. Connectors 130 are positioned between each mounting component 110 and the print frame 140, which as shown includes an optional upper portion 141. Fluid inlets 170 supply fluid to each fluid ejection module 100, and optional fluid outlets 180 provide a fluid return path for each fluid ejection module 100. As is discussed in further detail below, the method, apparatus, and systems described herein allow for precise alignment of a fluid ejection module 100 not only to the print frame 140, but relative to one or more other fluid ejection modules 100 as well.

Figure 2:
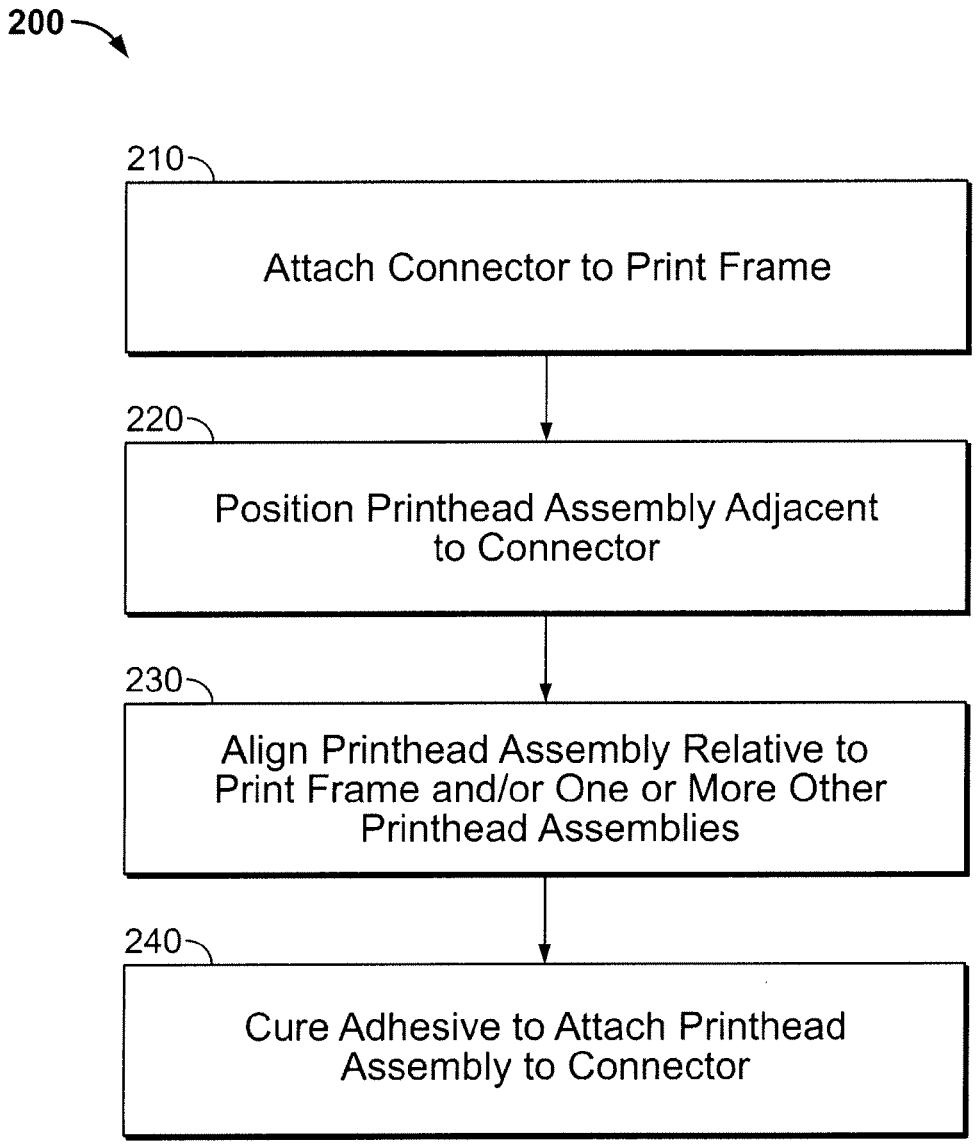
FIG. 2 is a flowchart showing an example process for mounting the example fluid ejection module to the print frame.

FIG. 2 is a flowchart showing an example process 200 for mounting a fluid ejection module 100 to a print frame 140. For illustrative purposes, the process 200 shall be described in the context of mounting the example fluid ejection module 100 shown in FIG. 1A to the example print frame 140, however, it should be understood the process 200 can be implemented to mount a differently configured fluid ejection module 100 to the same or a differently configured print frame 140.

The connector 130 is attached to the print frame 140 (step 210). As previously described, preferably the connector 130 is detachably attached to the print frame 140 to allow for relatively easy removal at a later time without damaging the print frame 140. In one implementation, the connector 130 is attached to the print frame 140 by one or more screws received within threaded openings 145 (see FIG. 38) formed within the print frame 140.

Adhesive 485, or some material that becomes adhesive on curing, is applied to a surface of the connector 130, to the mounting surface 120 of the mounting component 110, or both. The fluid ejection module 100 is positioned adjacent to the connector 130 with the mounting surface 120 facing the connector 130 (step 220). The fluid ejection module 100 is then aligned relative to the print frame 140 or relative to one or more neighboring fluid ejection modules 100 or both (step 230). The adhesive 485 can be formed from a material that, when uncured, allows for relative movement between the fluid ejection module 100 and the connector 130 to facilitate the alignment process. Once the alignment is achieved, the adhesive 485 can then be cured to affix the fluid ejection module 100 to the connector 130 (step 240). Once the adhesive 485 is cured, no significant relative movement of the fluid ejection module 100 and the connector 130 is possible.

Figure 3A:
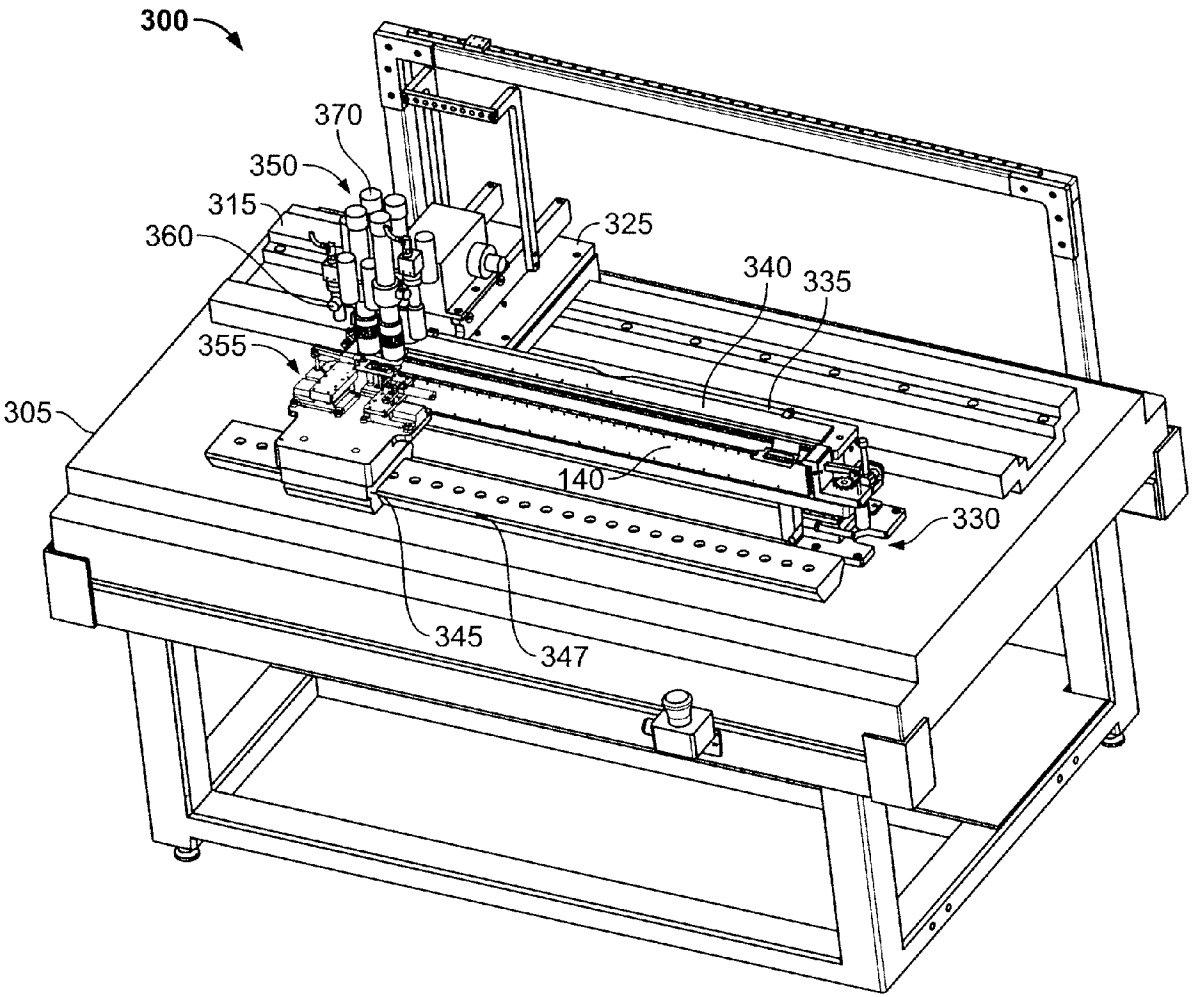
FIG. 3A is a perspective view of an example alignment apparatus.

FIG. 3A shows an example alignment apparatus 300 supporting the print frame 140 and the fluid ejection module 100. The alignment apparatus 300 is one example of a device that can be used to achieve the alignment step 230 described above. However, it should be understood that other configurations of the alignment apparatus 300 can be used, and the apparatus described is but one example. For illustrative purposes, the alignment apparatus 300 is described in the context of aligning the fluid ejection module 100 to the print frame 140, although it should be understood that the alignment apparatus 300 can be used to align a differently configured fluid ejection module 100 to the same or a differently configured print frame 140.

In this implementation, the alignment apparatus 300 includes a base 305. A camera support rail 315 is mounted on the base 305, and a camera support 325 is mounted on, and configured to move along, the camera support rail 315. The camera support 325 supports a camera assembly 350. A print frame support 330 is also mounted on the base 305. The print frame support 330 supports the print frame 140 and a mask holder 335. The mask holder 335 supports an alignment mask 340. The alignment mask 340 can be used together with the camera assembly 350 to align one or more fluid ejection modules 100 to the print frame 140, as discussed in more detail below. A manipulator assembly 355 is mounted to the base 305 by a manipulator base 345 and a manipulator rail 347. The manipulator assembly 355 is configured to move the fluid ejection module 100 relative to the print frame. The manipulator base 345 is configured to move along the manipulator rail 347.

Figure 3B:
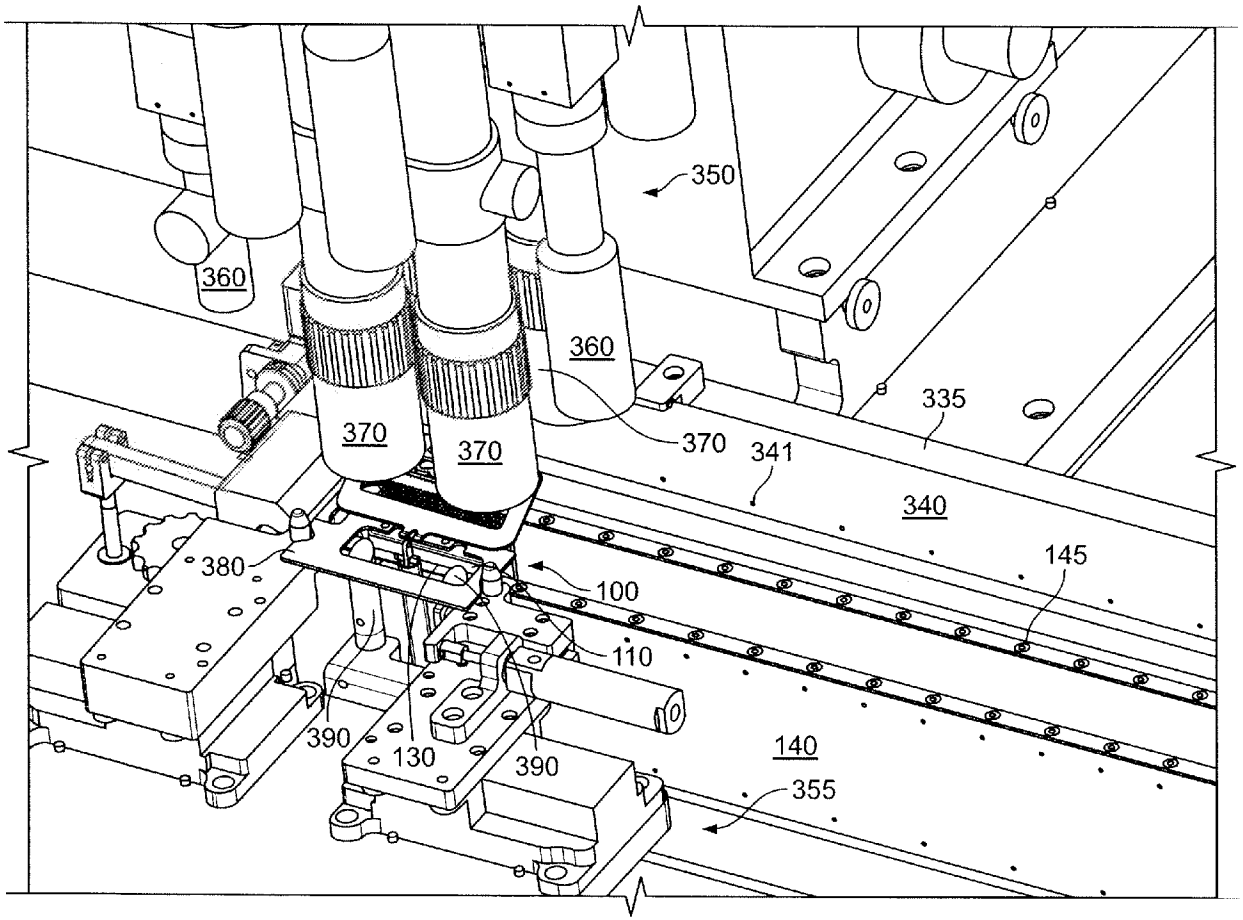
FIG. 3B is a perspective view of a portion of the alignment apparatus shown in FIG. 3A.

FIG. 3B is a close-up view of a portion of the alignment apparatus 300. The fluid ejection module 100 is positioned in the print frame 140. The connector 130 is positioned between the mounting component 110 and the print frame 140, and the connector 130 is attached to the print frame 140. The mask holder 335 supports the alignment mask 340, and the alignment mask 340 includes fiducials 341, which are discussed in more detail below. The manipulator assembly 355 includes a manipulator plate 380 configured such that movement of the manipulator plate 380 effects movement of the fluid ejection module 100 relative to the print frame 140.

In this implementation, the camera assembly 350 includes two low magnification cameras 360 and four high magnification cameras 370, although more or fewer cameras can be used. The high magnification cameras can be calibrated using a calibration mask 344 (see FIG. 3E), as discussed in more detail below. Light emitters 390 are configured to direct light at the connector 130. In this implementation, the light emitters 390 are configured to emit ultraviolet light.

Figure 3C:
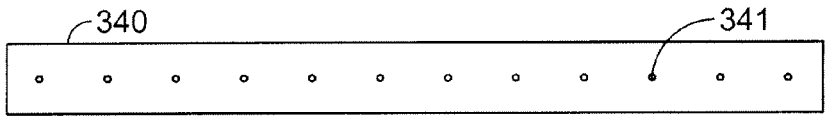
FIG. 3C is a schematic representation of an alignment mask.

FIG. 3C is a schematic representation of an implementation of the alignment mask 340. The alignment mask 340 includes one row of fiducials 341. The fiducials 341 can be used as reference marks for aligning the fluid ejection modules 100.

Figure 3D:
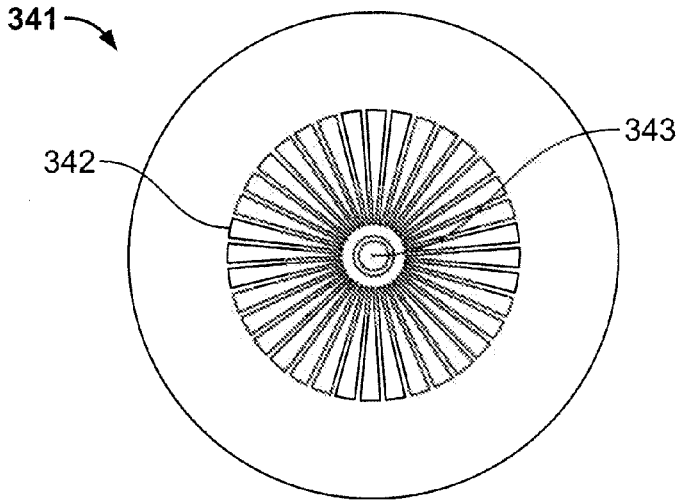
FIG. 3D is a schematic representation of a fiducial.

FIG. 3D is a schematic representation of an implementation of the fiducial 341. In this implementation, the fiducial 341 includes conspicuity features 342 arranged around a fiducial point 343. The conspicuity features 342 facilitate locating of the fiducial point 343 with the high magnification cameras 370. References in this disclosure to alignment with a fiducial 341 can refer to alignment with a fiducial point 343. That is, for example, aligning a high magnification camera 370 with a fiducial 341 can include aligning the high magnification camera 370 with a fiducial point 343. The conspicuity features 342 can be sized to be conspicuous to a low magnification camera 360, to a camera with no magnification, or to a human eye.

Figure 3E:
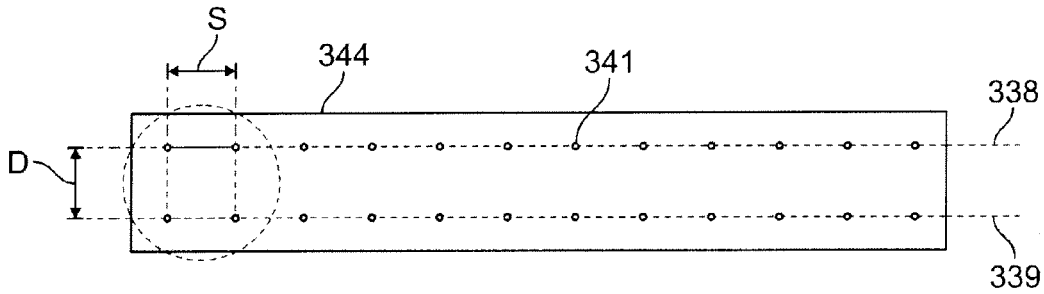
FIG. 3E is a schematic representation of a calibration mask.

FIG. 3E is a schematic representation of an implementation of the calibration mask 344. The calibration mask includes fiducials 341 arranged in a first row 338 and a second row 339. The fiducials 341 are configured such that the four high magnification cameras 370 are properly positioned when each of the four high magnification cameras 370 is aligned with a certain fiducial 341. A high magnification camera 370 is aligned with a fiducial 371 when the center of the field of view of the high magnification camera 370, or some other reference point within the field of view of the high magnification camera 370, is aligned with a fiducial 371. For example, the high magnification cameras 370 can be calibrated by alignment with the four fiducials 341 shown within a broken circle in FIG. 3E. In this implementation, the spacing S between the fiducials 341 in the first row 338 is equal to the spacing S between the fiducials 341 in the second row 339. The first row 338 and the second row 339 are parallel to each other and separated by a distance D. In some implementations, once calibrated, the four high magnification cameras 370 are maintained in a fixed relation with respect to each other after alignment, unless and until calibration is performed again.

Figure 3F:
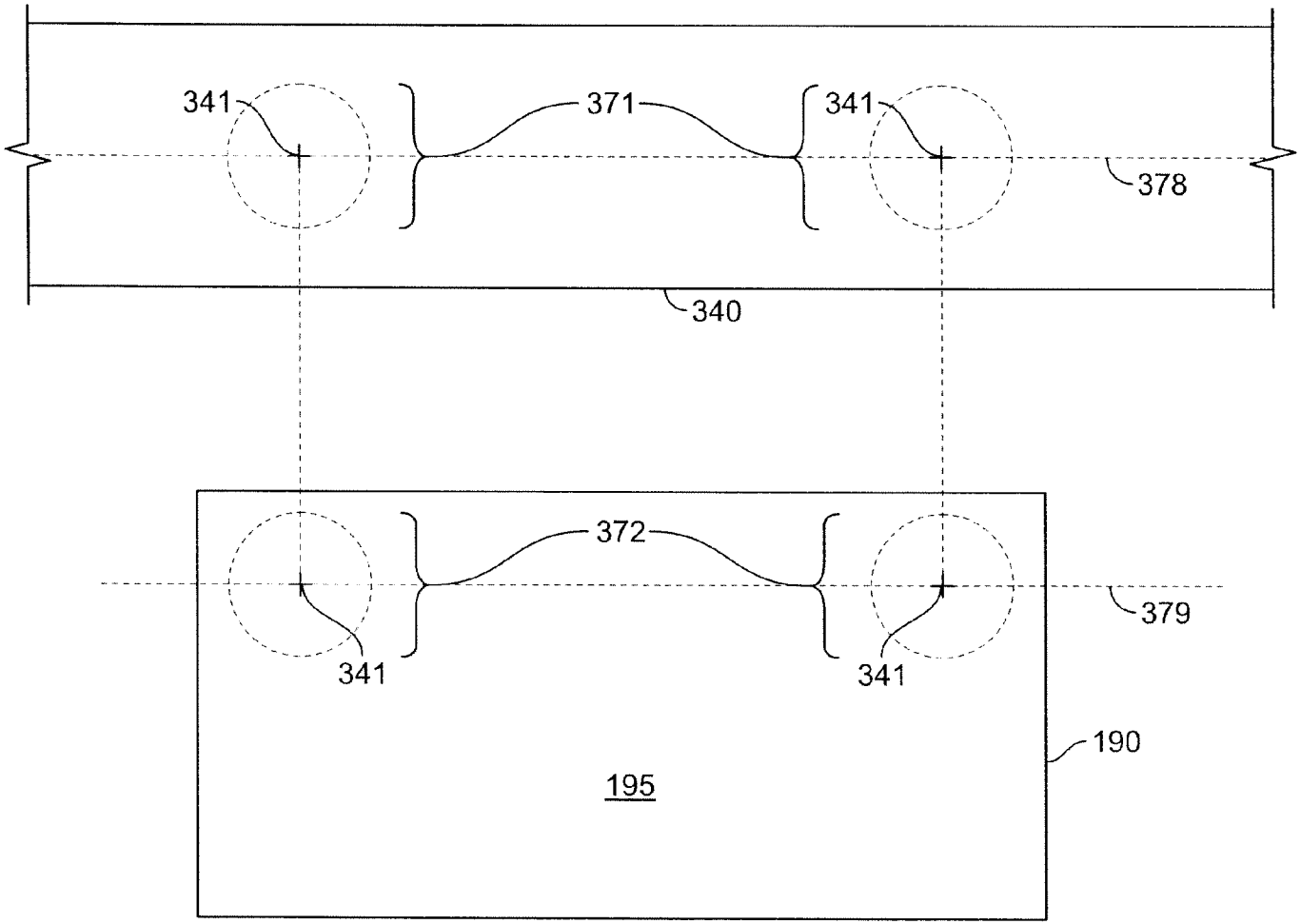
FIG. 3F is a schematic representation of an alignment mask and a nozzle face.

FIG. 3F is a schematic representation of an implementation of the alignment mask 340 and the substrate 190. The substrate 190 has a nozzle face 195 that can include two or more fiducials 341 (two fiducials in this example). The fiducials 341 on the nozzle face 195 are positioned such that a line defined by such fiducials 341 is parallel to a line defined by the fiducials 341 on the alignment mask 340 when the nozzle face 195 is properly aligned. Because the substrate 190 is attached to the fluid ejection module 100, proper alignment of the nozzle face 195 of the substrate 190 indicates proper alignment of the fluid ejection module 100.

The fields of view of the four high magnification cameras 370 are shown as broken circles in FIG. 3F. The fields of view each have a center represented by a crosshair in FIG. 3F for illustrative purposes. The centers of the fields of view of a first pair of high magnification cameras 370 define a first line 378. The centers of the fields of view of a second pair of high magnification cameras 370 define a second line 379. The high magnification cameras 370 are shown having been calibrated by the calibration mask 344, as described above, so the first line 378 and the second line 379 are parallel to each other and separated by a distance D. The first pair 371 of high magnification cameras 370 can be aligned to two of the fiducials 341 on the alignment mask 340. The second pair 372 of high magnification cameras 370 can be positioned over the nozzle face 195 of the fluid ejection module 100. Because the first line 378 and the second line 379 are parallel, a line defined by the fiducials 341 on the nozzle face 195 is parallel to a line defined by the fiducials 341 on the alignment mask 340 if the nozzle face 195 is properly aligned. Aligning the nozzle face 195 to the second pair 372 of high magnification cameras 370 thus achieves the desired alignment.

Figure 4A:
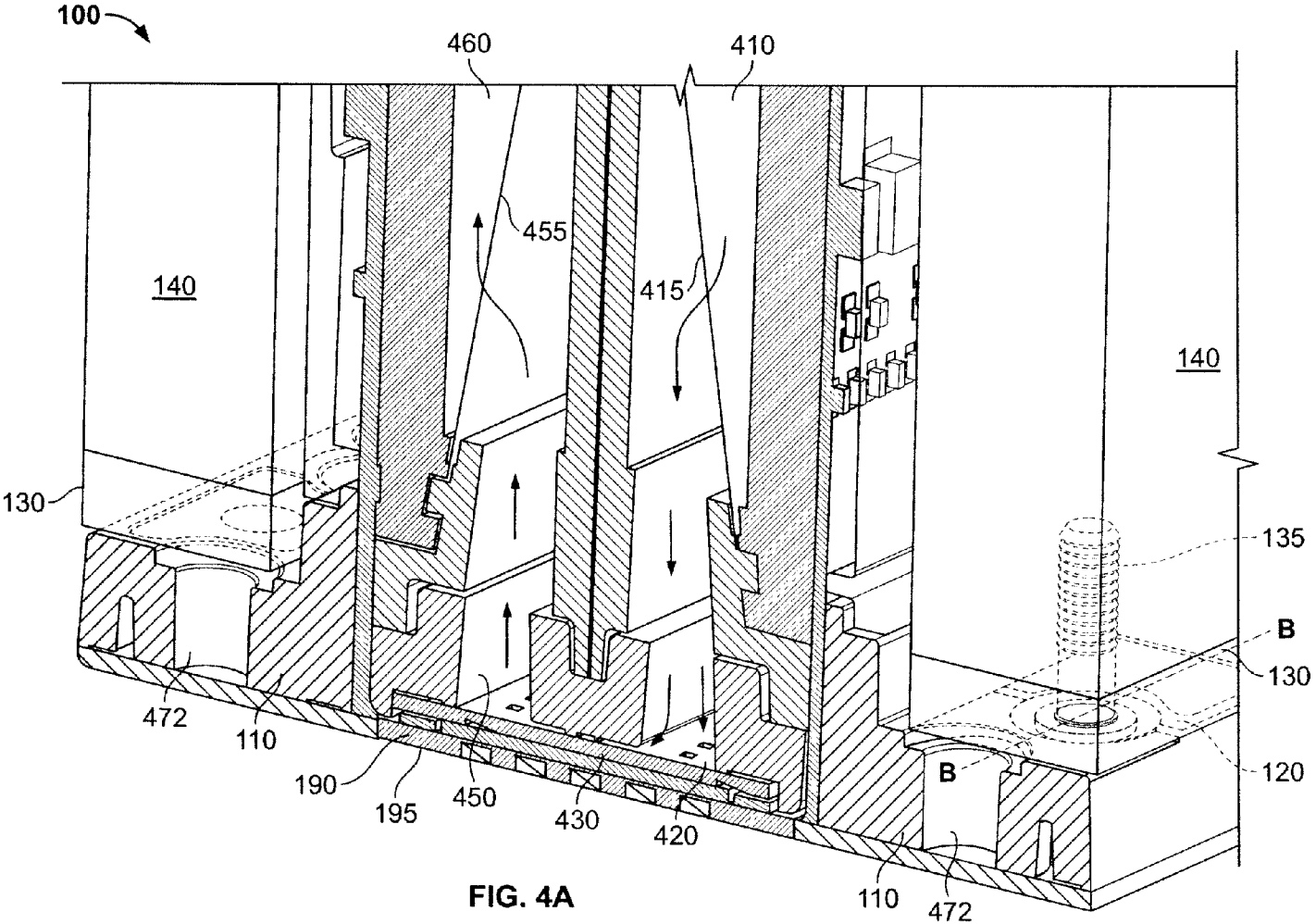
FIG. 4A is a cross-sectional perspective view of an example of a fluid ejection module mounted to a print frame.

FIG. 4A shows a cross-section of the example fluid ejection module 100 mounted to the print frame 140. The connector 130 is between the print frame 140 and the mounting surface 120 of the mounting component 110. The connector 130 is affixed to the print frame 140 by a screw 135, and the mounting component 110 is bonded to the connector 130, for example the mating surface 132 of the connector 130 that is opposite the print frame 140, by adhesive 485. The fluid ejection module 100 is but one example of a fluid ejection module 100 that can be mounted to the print frame 140 by way of the connector 130. Other configurations of fluid ejection modules can also be mounted to the print frame 140 using the connector 130. For illustrative purposes, the example fluid ejection module 100 is described in further detail below.

An optional cover 476 can be attached to a surface of the mounting component 110 opposite the connector 130. The cover 476 can include apertures 478 (see FIG. 4B) configured to allow access to the screw 135, such as for removing the screw 135. The cover 476 can be configured to prevent accumulation of fluid in any openings or recesses in the mounting component 110. In some implementations, the cover 476 can be attached to the mounting component 110 after the mounting component is attached to the connector 130. In an example where a secondary adhesive is applied, e.g., via openings 472 as discussed further below, the cover 476 is attached after applying the secondary adhesive. The cover 476 can be attached to the mounting component 110 by adhesion, a snap fitment, a fastener (e.g. screws, rivets, pins), or some other suitable mechanism.

Fluid can enter an upper supply chamber 410 of the fluid ejection module 100 from the fluid inlet 170 (see FIG. 1A). Fluid can pass from the upper supply chamber 410 through a supply filter 415 into a lower supply chamber 420. From the lower supply chamber 420, fluid can pass through an interposer 430 into the substrate 190. The substrate 190 can include a fluid passage 192 or multiple passages 192 and one or more nozzles (not shown) formed on the nozzle face 195. Fluid that is not ejected through any of the nozzles can exit the substrate 190 into a lower return chamber 450. Fluid can pass from the lower return chamber 450 through a return filter 455 (optional) and into an upper return chamber 460. Fluid can pass from the upper return chamber 460 into the fluid outlet 180 (see FIG. 1A).

In some implementations, a portion of the fluid passing through the fluid ejection module 100 does not enter the substrate 190, but instead can bypass the substrate 190 and pass directly from the lower supply chamber 420 to the lower return chamber 450. This bypass flow can facilitate a higher overall flow rate of fluid through the fluid ejection module 100, which can, for example, remove contaminants from the fluid ejection module 100 and facilitate temperature control of the fluid ejection module 100.

Figure 4B:
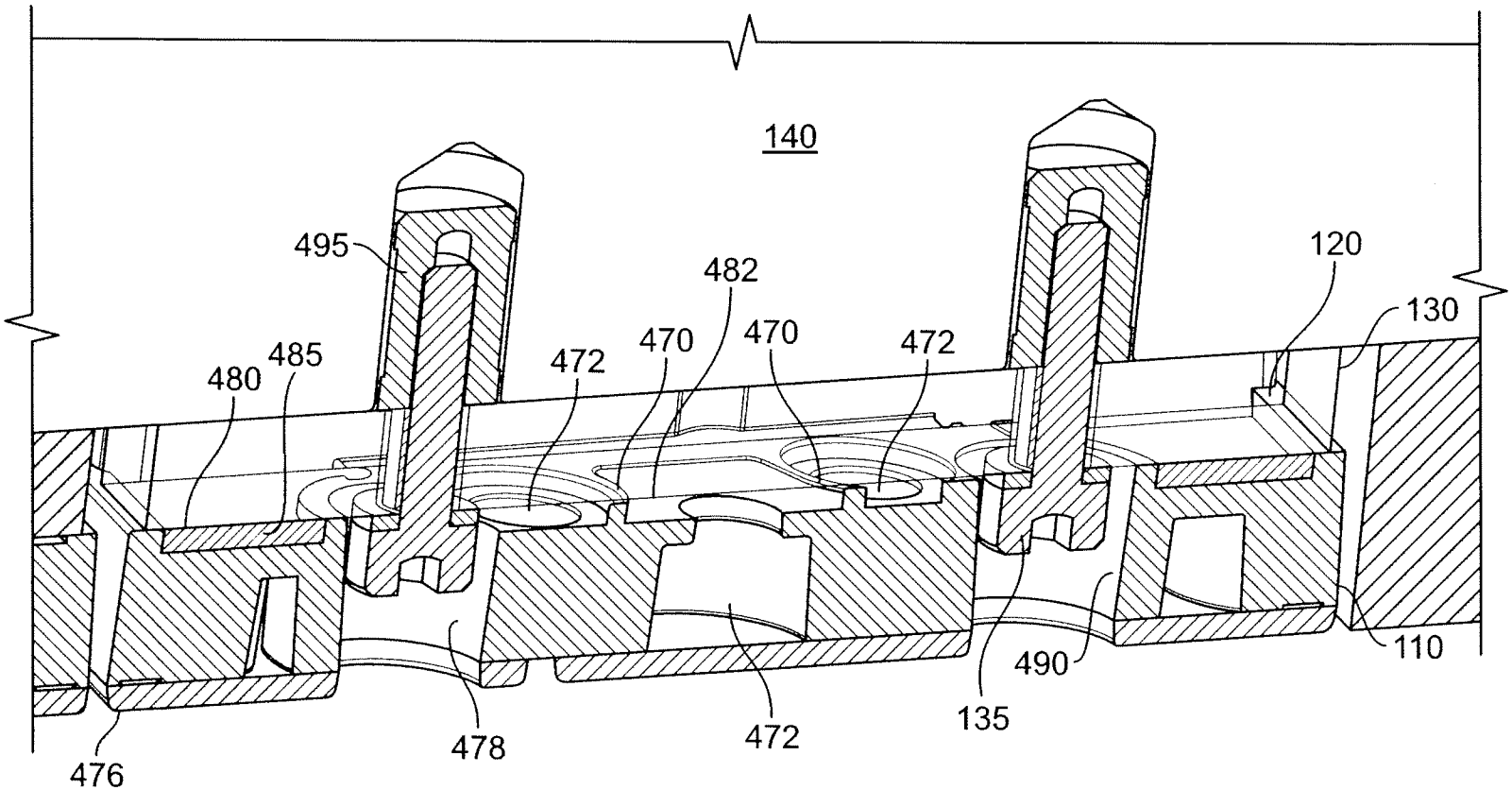
FIG. 4B is a cross-sectional perspective schematic representation taken along line B-B in FIG. 4A.
Figure 4C:
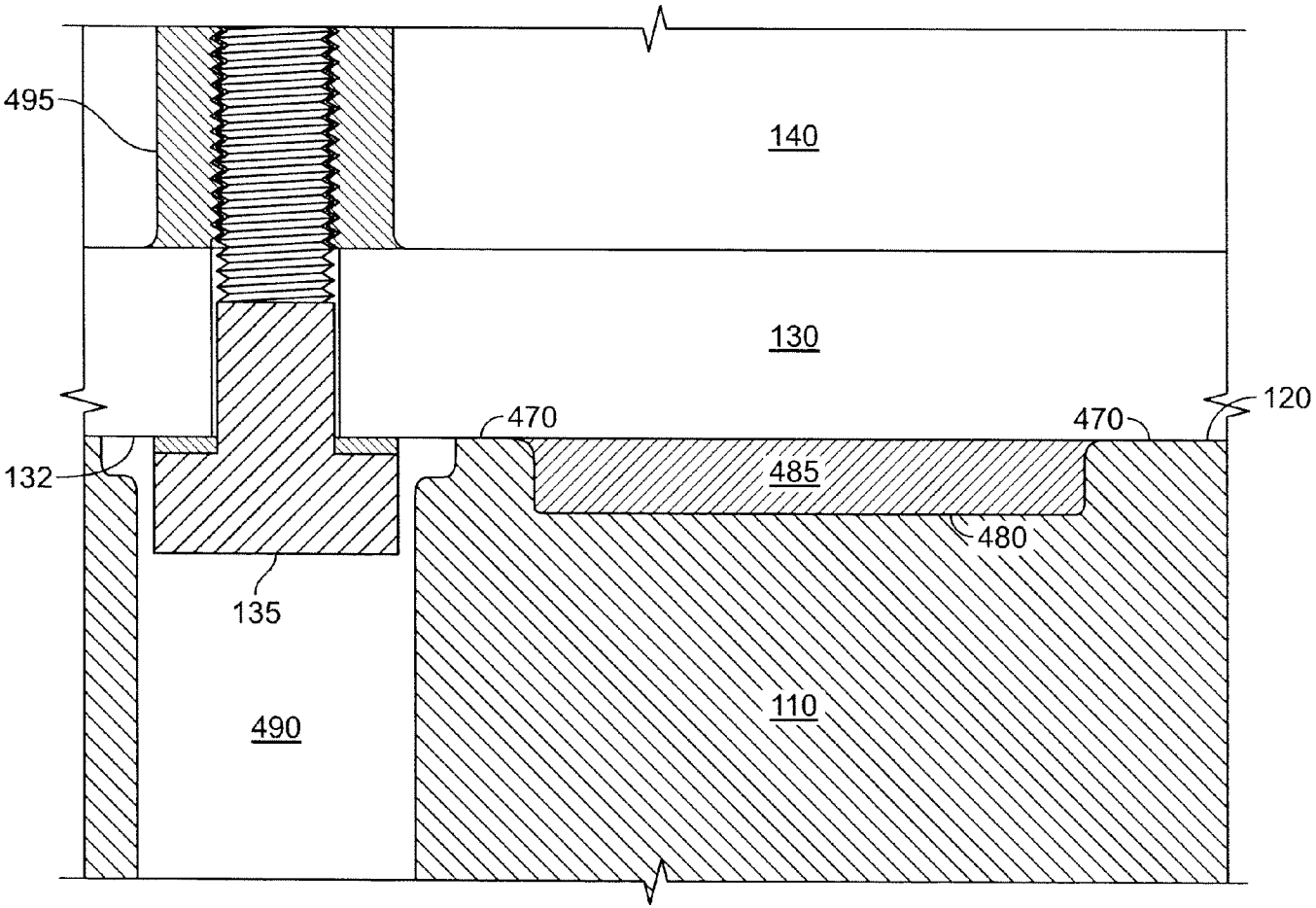
FIG. 4C is a cross-sectional planar schematic representation of a portion of the cross-section shown in FIG. 4B.

FIG. 4B is a schematic representation of a cross-section of a portion of the assembly shown in FIG. 4A taken along line 4B-4B shown in FIGS. 1A and 4A. In this implementation, the mounting surface 120 includes contact areas 470 that contact the connector 130, such as the mounting surface of the connector 130. The mounting component 110 also includes one or more recesses 480 configured to receive adhesive 485. Thus, the connector 130 and mounting surface 120 are in direct contact in the contact areas 470 and bonded with the adhesive 485 in the areas of the one or more recesses 480. In other implementations, the connector 130 includes one or more recesses configured to receive the adhesive in addition to, or instead of, the one or more recesses 480 in the mounting surface 120 of the mounting component 110. In implementations having multiple recesses 480, all of the recesses 480 can be of a same depth. Providing a uniform depth for the recesses 480 can result in a uniform thickness of adhesive 485 across the entire connector 130 and among multiple connectors 130 used to attach a particular fluid ejection module 130. This uniform thickness of adhesive 485 can reduce the likelihood of misalignment, such as by twisting of the fluid ejection module 100 during curing.

Non-uniform thickness of adhesive may be undesirable. For example, where the nozzle face 195 is intended to be orthogonal with the z direction, non-uniform thickness of the adhesive 485 may result in loss of this desired orthogonal relationship. If the adhesive 485 contracts during curing and the contraction causes movement of the fluid ejection module 100, non-uniform thickness of the adhesive 485 can result in some portions of the fluid ejection module 100 moving more than others. In the absence of recesses 480, the thickness of the adhesive 480 can be difficult to control for at least the reason that there is no direct contact between the mounting component 110 and the connector 130. A uniform in thickness of adhesive 485 can prevent misalignment during curing if expansion or contraction of the adhesive 485 has equal effects at all portions of the fluid ejection module 100 that cancel each other out. The recesses 480 therefore facilitate proper alignment of the fluid ejection module by controlling the thickness of the adhesive 485.

As discussed above, having the mounting surface 120 in direct contact with the connector at the contact areas 470 helps to maintain a desired relative position of the connector 130 and the mounting component 110 in the z direction, particularly if the adhesive 485 contracts during curing. The contact areas 470 can be referred to as "datums" or "datum features" since the contact areas 470 can establish a desired relationship between the fluid ejection module and the connector with higher accuracy and precision than might be attained without such features. Direct contact between the connector 130 and the contact areas 470 can mitigate or prevent relative movement of the connector 130 and the mounting component 110 in the z direction, e.g., if the mounting component 110 is resistant to compression or other deformation. Accordingly, the mounting component 110 can be composed of a material resistant to deformation. For example, the mounting component 110 can be composed of liquid crystal polymer (LCP).

The contact areas 470 can be formed in a manner during manufacturing of the mounting component 110 that provides a desired level of accuracy and precision in the contact between the mounting component 110 and the connector 130. For example, the contact areas 470 can be manufactured with a desired degree of flatness across the mounting surface 120 of the mounting component 110 to minimize non-uniformity of contact between the mounting component 110 and the connector 130. For example, the contact areas 470 can be manufactured with a degree of flatness across the mounting component 110 that facilitates contact of all contact areas 470 with the connector 130. That is, it may be desirable that all contact areas 470 are in contact with the connector 430 so as to avoid warping of the connector 130, the mounting component 130, or both, before, during, or after curing of the adhesive 485. The contact areas 470 can also be formed with a desired parallelism with the nozzle face 195 and with contact areas 470 on other mounting components 110 of a same fluid ejection module 100.

Optionally, the mounting component 110 can include one or more openings 472 (see FIGS. 4A and 4B) for applying a secondary adhesive at the interface between the mounting component 110 and the connector 130. The secondary adhesive can be of a non-ultraviolet curing type and may in some implementations provide additional bond strength between the mounting component 110 and the connector 130. The secondary adhesive can be allowed to cure after the ultraviolet adhesive has been cured. The secondary adhesive can be, for example, an epoxy-type adhesive. The secondary adhesive can be introduced into a secondary recess 482 (see FIG. 4B) through the opening 472. The optional cover 476 can cover the opening 472.

In this implementation, the mounting component 110 includes apertures 490 that allow removal of the screws 135 or other such connection device. Removal of all of the screws 135 that attach the connector 130 to the print frame 140 allows detachment and removal of the connector 130 from the print frame 140 without damage to the print frame 140. The fluid ejection module 100 can thereby be removed together with the connector 130 by removing the screws 135.

Figure 5:
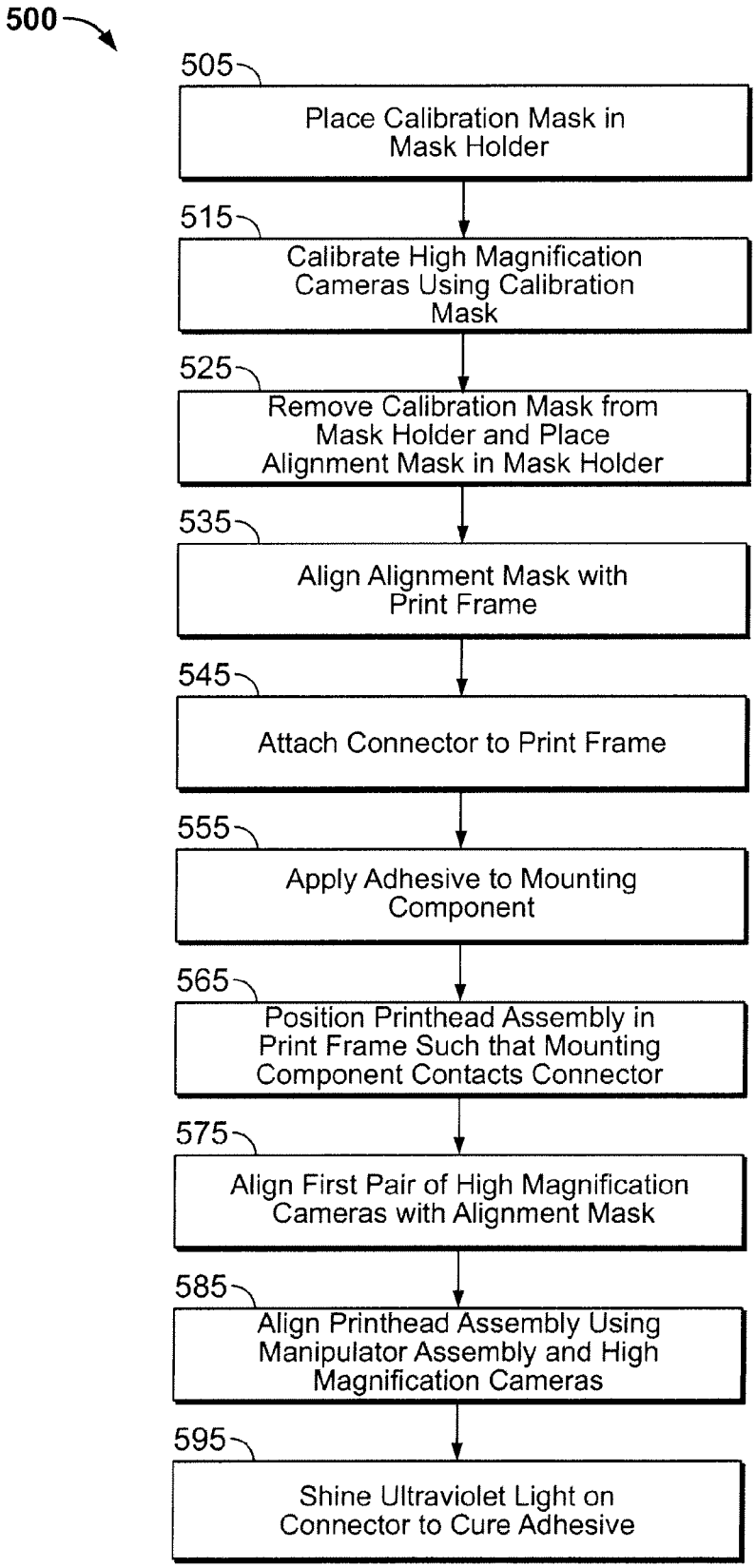
FIG. 5 is a flowchart showing an example process for aligning and mounting a fluid ejection module using the apparatus shown in FIG. 3A.

FIG. 5 is a flowchart showing an alternative process 500 for mounting a fluid ejection module 100 to a print frame 140. To align and mount a fluid ejection module 100, the calibration mask 344 is placed in the mask holder 335 (step 505). The four high magnification cameras 370 are calibrated using the calibration mask 344 (step 515). The calibration mask 344 is then removed from the mask holder 335, and the alignment mask 340 is placed in the mask holder 335 (step 525). The alignment mask 340 is aligned to the print frame 140 (step 535). The connector 130 is then attached to the print frame 140 (step 545). Adhesive is applied to the mounting component 110 so as to at least partially occupy the recess 480 (step 555). A fluid ejection module 100 is positioned in the print frame 140 such that a surface of the connector 130 contacts the contact areas 470 on the mounting surface 120 of the mounting component 110 (step 565). The first pair 371 of high magnification cameras 370 are then aligned with fiducials 341 on the alignment mask 340 (step 575). The manipulator assembly 355 engages with the fluid ejection module 100 by placing the manipulator plate 380 in contact therewith. The manipulator assembly 355 can then manipulate the fluid ejection module 100 so that the fiducials 341 on the nozzle face 195 align with the second pair 372 of high magnification cameras 370 (see FIG. 3F) (step 585). The light emitters 390 then shine light on the connector 130 (step 595). In this implementation, the light is ultraviolet light. Because the connector 130 in this implementation is transparent, the light travels through the connector 130 and reaches the adhesive. In this implementation, the adhesive is of a type that cures when exposed to ultraviolet light. The light emitters 390 shine light for a sufficient length of time to cure the adhesive. Additional fluid ejection modules 100 can be aligned and mounted to the print frame 140 in a similar manner.

Alternatively, adhesive can be applied to the connector 130, and the adhesive can flow to at least partially occupy the recess 480 when the mounting surface 120 of the mounting component 120 is brought into contact with the contact areas 470. Also, the first pair 371 of high magnification cameras 370 can be aligned with fiducials 341 on the alignment mask 340 before affixing the connector 130 to the print frame 140, before applying adhesive to the mounting component 110, before placing the fluid ejection module 100 in the print frame 140, or at some other time.

In some implementations, the alignment apparatus 300 includes manipulator actuators configured to control the manipulator assembly 355. The alignment apparatus 300 can further include a microprocessor programmed to receive input from the two pairs of high magnification cameras 370 and to provide signals controlling the manipulator actuators. The apparatus can further include actuators to control the movable camera support 325. In one implementation, a microprocessor is programmed to receive input from the two pairs of high magnification cameras 370 and to control the camera support 325 actuators and the manipulator actuators.

Figure 6:
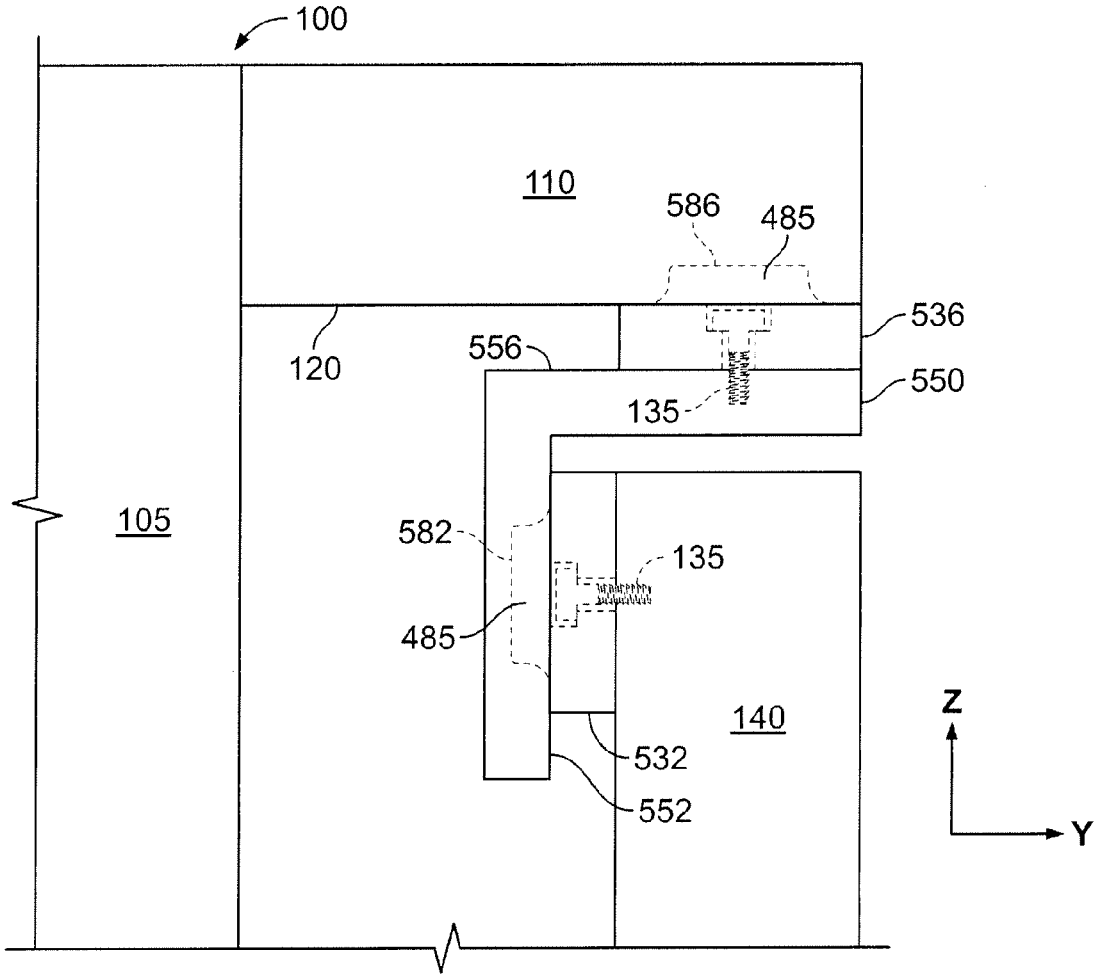
FIG. 6 is a cross-sectional schematic representation of an example fluid ejection module mounted to a print frame.

FIG. 6 is a cross-sectional schematic representation of an alternative implementation of a system for mounting a fluid ejection module 100. In this implementation, a first connector 532 and a second connector 536 are used such that the position of the fluid ejection module 100 relative to the print frame can be adjusted in three dimensions. In the particular example shown, a bracket 550 is included having a first mating surface 552 and a second mating surface 556. The bracket 550 can be formed such that the first mating surface 552 and the second mating surface 556 are at right angles relative to each other. The first connector 532 is attached by a screw 135 to a surface of the print frame 140 proximate the printhead casing 105. The first mating surface 552 of the bracket 550 is arranged proximate a surface of the first connector 532 that is opposite the print frame 140. When so arranged, the second mating surface 556 is on a side of the bracket 550 opposite the print frame 140. The bracket 550 is attached to the first connector 532 by an adhesive 485 that resides in a first recess 582 in the first mating surface 552 of the bracket 550. The second connector 536 is attached by a screw 135 to the second mating surface 556 of the bracket 550. The fluid ejection module 100 is arranged such that the mounting surface 120 of the mounting component 110 is proximate a surface of the second connector 536 that is opposite the second mating surface 556 of the bracket 550. The mounting component 110 is attached to the second connector 536 by an adhesive 485 that resides in a second recess 586 formed in the mounting surface 120 of the mounting component 110. The fluid ejection module 100 is thus attached to the print frame by way of the first connector 532, the bracket 550, and the second connector 536.

By using the bracket 550, the position of the fluid ejection module can be adjusted in the x, y and z directions relative to the print frame. For example, the bracket 550 can be positioned such that the second mating surface 556 is at a desired position in the z direction. Alternatively, the second connector 536 can already be attached to the bracket 550, and the bracket 550 can be positioned such that the second connector 536 is at a desired position in the z direction. Further, to the extent not constrained by interference with the print frame 140 or other components, the bracket 550 can be rotated about the y direction to achieve a desired angular position. Adhesive 485 in the first recess 582 can then be cured to fix the position of the bracket 550.

The fluid ejection module 100 can then be positioned on the second connector 536 and aligned as desired in the x direction and the y direction. The adhesive 486 in the second recess 586 can then be cured to attach the fluid ejection module to the second connector 536. This implementation thus permits adjustment of the position of the fluid ejection module 100 in three dimensions. Where multiple fluid ejection modules 100 are being mounted in the print frame 140 and aligned, multiple brackets 550 can be used. For example, some or all of the brackets 550 can be positioned such that some or all of the second mating surfaces 556 or the second connectors 536 are in a common position in the z direction. This adjustability can allow for accurate alignment of the fluid ejection modules 100 in the z direction, for example, to compensate for manufacturing irregularities in the thickness of the mounting component 110 or the relationship between the mounting component 110 and other components of the fluid ejection module 100, such as the substrate 190.

Although the above example using two connectors to adjust the position of the fluid ejection module uses a bracket, other configurations are possible. Any number of connectors and other components (e.g., a bracket) can be used, so long as the fluid ejection module can be adjusted in three directions before becoming affixed to the one or more connectors being used to connect to the print frame.

In the implementations shown and described herein, the connector 130 is configured as a substantially rectangular component formed entirely from a material permitting the transmission of light. However, other configurations of the connector 130 are possible. For example, the connector 130 can be formed from two or more separate components rather than one integral component. The connector 130 can include portions that are not transparent or translucent, so long as there is at least one portion that allows the transmission of light so as to cure a light-sensitive (e.g., UV light sensitive) adhesive. In other implementations, the connector 130 can be opaque. Also, in some implementations, the adhesive can be of a type curable in a manner other than by light, such as by time, temperature, chemical reaction, or some other process, characteristic, or property. The connector 130 does not have to be configured in a substantially rectangular shape, and can be configured differently, for example, to conform to a differently configured mounting component of a fluid ejection module 100. As described above, in one example, the connector 130 is formed from glass. However, in other implementations, the connector 130 can be formed from materials having a coefficient of thermal expansion similar to that of the fluid ejection module 100 and the print frame 140. For example, the connector 130 can be composed of silicon, liquid crystal polymer (LCP), silicon carbide, quartz, or some other suitable material. The components described herein, for example, the mounting component 110, the connector 130, and the print frame 140, can be formed from materials having a low coefficient of thermal expansion in some implementations.

The methods and apparatus described above are in the context of connecting a fluid ejection module to a print frame. However, the methods and apparatus can be used in other applications. For example, the connector and bonding techniques described can be used to with a MEMS device assembly in which MEMS devices, such as actuators or sensors, are formed in the substrate of the fluid ejection module 100. This can permit precise alignment of multiple MEMS device assemblies relative to each other.

A fluid ejection module 100 and a mounting component 110 for the fluid ejection module are described above. An exemplary fluid deposited by the fluid ejection module 100 is ink. However, it should be understood that other fluids can be used, for example, electroluminescent material used in the manufacture of light emitting displays, liquid metals used in circuit board fabrication, or biological fluid.

The use of terminology such as "front," "back," "top," and "bottom" throughout the specification and claims is for illustrative purposes only, to distinguish between various components of the fluid ejection module and other elements described herein. The use of "front," "back," "top," and "bottom" does not imply a particular orientation of the fluid ejection module. Similarly, the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention. Accordingly, other embodiments are within the scope of the following claims.

What is claimed is:

1. A system comprising:

a frame configured to mount one or more fluid ejection modules;

the one or more fluid ejection modules, each fluid ejection module including a mounting component having a mounting surface;

one or more connectors configured to detachably attach to the frame and positioned between the frame and the mounting surfaces of the one or more fluid ejection modules, wherein a portion of a mating surface of the connector positioned adjacent the mounting surface of a corresponding fluid ejection module is in direct contact with the mounting surface;

one or more recesses formed in at least one of either the mounting surfaces of the one or more fluid ejection modules or the mating surfaces of the one or more connectors, where the one or more recesses have a substantially uniform thickness and are filled with an adhesive; and the adhesive comprising a substantially uniform layer formed within the one or more recesses, wherein the adhesive corresponding to a fluid ejection module is cured after aligning the fluid ejection module to the frame.

2. The system of claim 1, further comprising a screw to detachably attach the connector to the frame.

3. The system of claim 1, wherein at least a portion of the connector comprises a light-transmissive material and wherein the adhesive is cured by exposure to light transmitted through the light transmissive portion of the connector.

4. The system of claim 1, wherein the one or more fluid ejection modules include fiducials for aligning the one or more fluid ejection modules to the frame.

5. The system of claim 1, wherein the adhesive is positioned such that substantially all contraction of the adhesive during curing occurs perpendicular to the mounting surface.

6. The system of claim 1, wherein the mounting component further includes one or more openings configured to receive a second adhesive at an interface between the mounting component and the connector.

7. A method for mounting a fluid ejection module to a frame, comprising:

attaching a first surface of a connector to the frame;

positioning a mounting surface of the fluid ejection module adjacent to an opposing second surface of the connector, wherein at least one of either the mounting surface or the opposing second surface of the connector includes one or more recesses filled with an adhesive;

aligning the fluid ejection module to the frame; and after aligning the fluid ejection module, curing the adhesive positioned between the mounting surface and the second surface of the connector thereby securing the fluid ejection module to the connector, wherein a portion of the mounting surface of the fluid ejection module and a portion of the second surface of the connector are in direct contact and the adhesive is positioned such that substantially all contraction of the adhesive during curing occurs perpendicular to the mounting surface.

8. The method of claim 7, wherein aligning the fluid ejection module to the frame further comprises aligning the fluid ejection module to one or more fluid ejection modules mounted to the frame.

9. The method of claim 7, wherein:

at least a portion of the connector comprises a light-transmitting material;

the adhesive comprises an ultra-violet sensitive adhesive; and curing the adhesive comprises exposing the adhesive to ultra-violet light through the light-transmitting portion of the connector.

10. The method of claim 7, wherein aligning the fluid ejection module comprises:

aligning a mask to the frame;

aligning a first pair of cameras to fiducials on the mask; and aligning the fluid ejection module with a second pair of cameras that are in a fixed relationship with the first pair of cameras.

11. The method of claim 10, wherein aligning the fluid ejection module comprises calibrating the first pair of cameras and the second pair of cameras using a calibration mask.

12. A system comprising:

a frame configured to mount one or more MEMS device assemblies;

the one or more MEMS device assemblies, each MEMS device assembly including a mounting component having a mounting surface;

one or more connectors configured to detachably attach to the frame and positioned between the frame and the mounting surfaces of the one or more MEMS device assemblies, wherein a portion of a mating surface of a connector positioned adjacent the mounting surface of a corresponding MEMS device assembly is in direct contact with the mounting surface;

one or more recesses formed in at least one of either the mounting surfaces of the one or more MEMS device assemblies or the mating surfaces of the one or more connectors, where the one or more recesses have a substantially uniform thickness and are filled with an adhesive; and the adhesive comprising a substantially uniform layer formed within the one or more recesses, wherein the adhesive corresponding to a MEMS device assembly is cured after aligning the MEMS device assembly to the frame.

13. The system of claim 12, wherein each of the one or more MEMS device assemblies comprises an actuator.

14. The system of claim 12, wherein each of the one or more MEMS device assemblies comprises a sensor.

15. A system comprising:

a frame configured to mount one or more fluid ejection modules;

the one or more fluid ejection modules, each including a mounting component;

a first connector detachably attached to the frame;

a bracket having a first mating surface and a second mating surface, the first mating surface being positioned in contact with the first connector;

a second connector detachably attached to the bracket and in contact with the mounting component;

one or more recesses formed in at least one of either the first and second mating surfaces of the bracket or a mating surface of the one or more connectors, where the one or more recesses have a substantially uniform thickness and are filled with an adhesive; and the adhesive comprising a substantially uniform layer formed within the one or more recesses, wherein for each fluid ejection module, the adhesive at an interface between the first mating surface and the first connector is cured after aligning the bracket to the frame in a first direction, and the adhesive at an interface between the second mounting surface and the second connector is cured after aligning the fluid ejection module to the frame in a second direction and a third direction.

* * * * *